US009987651B2

(12) United States Patent
McFadden

(10) Patent No.: US 9,987,651 B2
(45) Date of Patent: Jun. 5, 2018

(54) EXHAUST PIT, SYSTEM, AND METHODS OF USING THE SAME

(71) Applicant: Global Finishing Solutions LLC, Osseo, WI (US)

(72) Inventor: William McFadden, Barrie (CA)

(73) Assignee: Global Finishing Solutions LLC, Osseo, WI (US)

( * ) Notice: Subject to any disclaimer, the term of this patent is extended or adjusted under 35 U.S.C. 154(b) by 216 days.

(21) Appl. No.: 14/820,019

(22) Filed: Aug. 6, 2015

(65) Prior Publication Data

US 2016/0038962 A1 Feb. 11, 2016

Related U.S. Application Data

(60) Provisional application No. 62/033,846, filed on Aug. 6, 2014.

(51) Int. Cl.
*F23J 13/08* (2006.01)
*B05B 15/12* (2006.01)

(52) U.S. Cl.
CPC ..... *B05B 15/1222* (2013.01)

(58) Field of Classification Search
CPC ..... B05B 12/1222; B05B 12/1225
USPC ..... 454/49, 50–55
See application file for complete search history.

(56) References Cited

U.S. PATENT DOCUMENTS 3,561,135 A * 2/1971 Fulford ..... B05B 15/1207 118/326
4,537,120 A * 8/1985 Josefsson ..... B05B 15/1222 454/52
4,775,001 A 10/1988 Ward et al.
5,467,609 A 11/1995 Feeney
6,132,309 A 10/2000 Panelli

FOREIGN PATENT DOCUMENTS

JP 2008157607 A 7/2008

OTHER PUBLICATIONS

Table of loads for a pressed grating; Kind 20, Jul. 21, 2011, [online] [retrieved on 27.01.206] Retrieved from the Internet: <URL:http://www.perfodeco.ru/wp-content/uploads/2013/07/tablitsa-nagruzok-pressovannogo-nastila.pdf>.
International Search Report and Written Opinion of PCT/US2015/044014, filed Aug. 6, 2015.

* cited by examiner

*Primary Examiner* — Vivek Shirsat
(74) *Attorney, Agent, or Firm* — Scherrer Patent & Trademark Law, P.C.; Stephen T. Scherrer; Monique A. Morneault

(57) ABSTRACT

The present invention relates to floor exhaust pits. Specifically, the present invention relates to a raised basement with an exhaust system therein for use in numerous locations. More specifically, the present invention provides an enclosed area having a floor and a ceiling, wherein said floor and ceiling comprise exhaust systems for circulating air into and out of the enclosed area. Additionally, the floor exhaust removes contaminants from the enclosed area.

7 Claims, 4 Drawing Sheets

EXHAUST PIT, SYSTEM, AND METHODS OF USING THE SAME

The present invention claims priority to U.S. Provisional Patent App. No. 62/033,846, titled "Exhaust Pit, System, and Methods of Using the Same," filed Aug. 6, 2014, which is incorporated herein expressly in its entirety.

TECHNICAL FIELD

The present invention relates to floor exhaust pits. Specifically, the present invention relates to a raised basement with an exhaust system therein for use in numerous locations. More specifically, the present invention provides an enclosed area having a floor and a ceiling, wherein said floor and ceiling comprise exhaust systems for circulating air into and out of the enclosed area. Additionally, the floor exhaust removes contaminants from the enclosed area.

BACKGROUND

It is well known to use exhaust systems. Exhaust systems may be used to create air flow, circulate air, heat, cool, remove air, remove contaminants, or otherwise sterilize environments. Exhaust systems may be used in a plurality of applications including but not limited to painting, welding, body work, cleaning, and the like. It is often important to create and maintain an air flow to facilitate the work process.

Exhaust systems are needed specifically for welding. Commonly, ferrous metals and other like contaminants may interfere with aluminum welds and corrode aluminum. For example, steel particles may contaminate aluminum welds, and contaminants such as steel, chrome, zinc, manganese, boron or lead may corrode and deteriorate aluminum surfaces in a process called galvanic corrosion. Care must be taken to ensure that aluminum repair is not subject to exposure to these and other types of contaminants. Often, it is difficult to sequester aluminum parts from contaminants that may interfere with aluminum welds and otherwise may corrode or deteriorate aluminum surfaces. In addition, aluminum dust, which may be generated during aluminum repair, when mixed with iron oxide particles and/or magnesium, may combust in a thermite reaction, causing injury and damage.

Similarly, paint and other like solutions have well known hazards associated with them when coming into contact with humans and other living things. They include, generally, rashes; swelling; eye irritation; sore throat, cough, fatigue, nausea, and dizziness from short term inhalation; liver, kidney, lung, digestive system, and central nervous system damage from long term or massive exposure; fire, explosions; and reactivity from mixing of volatile substances. Many of these hazards may be avoided by painting in a location that has very good ventilation.

Objects may be painted in open areas. Dust, water, hair, debris, pollen, or other contaminants may come into contact with the object or otherwise become coated in the paint. This may cause bumps or imperfections in the paint, which require additional time, paint, and labor to correct. Commonly objects are painted in work booths to prevent any contaminants from affecting the painting process. These booths are made to provide sufficient ventilation while protecting objects from contaminants. Whether one paints in an open area or within a booth, painting in a time consuming process. It takes time to prepare the object for painting, to actually paint the object, to let the paint dry, to add additional coats of paint, and to allow the additional coast of paint to dry.

To ensure that contamination does not occur, proper ventilation and exhaust systems must be utilized so the air is free of contaminants, such as paint, chemicals, water vapor, steel, chrome, zinc, lead, manganese and boron dust. It is often difficult to install and utilize a proper ventilation and exhaust system for ensuring air is free of contamination. A need, therefore, exists for adequate ventilation and exhaust systems to ensure the working air is free of contamination.

Moreover, common exhaust systems fail to adequately allow for finishing of painted or welded products. A need, therefore, exists for sufficient ventilation that allows for the finishing of painted or welded products.

Often, floor exhausts provide many benefits. Generally, floor exhausts can suck in air that is dispensed from another source, such as the ceiling. This creates airflow from top to bottom. A need exists for floor exhausts that create airflow from top to bottom.

In order to have a floor exhausts, it generally must be built into the floor, which is often concrete or some other stationary material. Installing a floor exhaust into stationary material limits the work area to that location and permanently disfigures the floor. Often, because of location, it is not possible to install a floor exhaust within the concrete or other stationary material. A need exists for a floor exhaust that may be installed even when in-ground floor exhausts are not possible or severely limiting.

Installing floor exhaust systems often requires much assembly time and materials. Not only are some locations incapable of receiving a floor exhaust system, but those locations that are capable of receiving a floor exhaust system require extensive resources and time investments for installation. A need exists for a floor exhaust system that requires little time and resources for installation.

Often, floor exhaust systems involve two rows of pits instead of one larger pit. Two row pit systems provide greater suction in strategic locations, instead of having a general large surface area. Two row pit systems are disadvantageous, though, because one has to create two pits instead of one, which may involve twice the material and time, and one must coordinate the suction and exhausts between the two pits. The single pit is advantageous because a central exhaust tunnel or duct controls the suction throughout the single pit. Therefore, a need exists for an exhaust system that combines the advantages of the two pit system with a central exhaust tunnel or duct.

Additionally, floor exhaust systems are generally large and often around 2-4 feet deep or more. Raised floor systems, which are sometimes an alternative to in-ground floor exhaust systems, are often similar in size and require the entire room to be raised accordingly to accommodate the increase in floor height. A need exists for a compact floor exhaust system with a low height, such that the room the floor exhaust system is installed in does not have to be adjusted accordingly.

When raised floor systems are used, the height of the raised floor is higher than ground level. Ramps, steps, or other height increasing devices are often required to assist a person in going from one height to another. Alternatively, an entire area may be raised such that the difference in height of the raised floor and ground level is not apparent. Normally, if ramps or steps are used, they are attached adjacent the raised floor to not interfere with the exhaust system within the raised floor. Therefore, these ramps or steps are additional materials that take up additional space. A need exists for a sloped surface on the floor exhaust system that both transitions between ground level and the height of the raised floor and provides functionality to the floor exhaust system.

SUMMARY OF THE INVENTION

The present invention relates to floor exhaust pits. Specifically, the present invention relates to a raised basement with an exhaust system therein for use in numerous locations. More specifically, the present invention provides an enclosed area having a floor and a ceiling, wherein said floor and ceiling comprise exhaust systems for circulating air into and out of the enclosed area. Additionally, the floor exhaust removes contaminants from the enclosed area.

To this end, in an embodiment of the present invention an above ground exhaust pit is provided. The above ground exhaust pit comprises a platform disposed a length above a surface, at least one partially hollow passageway disposed between the platform and the surface, at least one grating disposed on the platform and above the at least one partially hollow passageway, and at least one filter disposed between the at least one partially hollow passageway and the at least one grating, wherein the at least one grating is capable of supporting more than 5,000 pounds.

In an alternate embodiment of the present invention, an above ground exhaust system is provided. The above ground exhaust system comprises an above ground exhaust pit comprising at least one partially hollow passageway disposed above a surface, and at least one grating having at least one filter disposed therein disposed above the at least one partially hollow passageway, wherein the above ground exhaust pit is capable of supporting more than 5,000 pounds; and an exhaust fan connected to the at least one partially hollow passageway.

It is, therefore, an advantage and objective of the present invention to provide apparatuses, systems, and methods that provide adequate ventilation and exhaust systems to ensure the working air is free of contamination.

It is an advantage and objective of the present invention to provide apparatuses, systems, and methods that allow for the finishing of painted or welded products.

It is an advantage and objective of the present invention to provide floor exhaust apparatuses, systems, and methods that implement airflows from top to bottom.

It is an advantage and objective of the present invention to provide apparatuses, systems, and methods that may be installed even when in-ground floor exhausts are not possible or severely limiting.

It is an advantage and objective of the present invention to provide a floor exhaust system that requires little time and resources for installation.

It is an advantage and objective of the present invention to provide an exhaust system that combines the advantages of the two pit system with a central exhaust tunnel or duct.

It is an advantage and objective of the present invention to provide a compact floor exhaust system with a low height, such that the room the floor exhaust system is installed in does not have to be adjusted accordingly.

It is an advantage and objective of the present invention to provide a sloped surface on the floor exhaust system that both transitions between ground level and the height of the raised floor and provides functionality to the floor exhaust system.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to floor exhaust pits. Specifically, the present invention relates to a raised basement with an exhaust system therein for use in numerous locations. More specifically, the present invention provides an enclosed area having a floor and a ceiling, wherein said floor and ceiling comprise exhaust systems for circulating air into and out of the enclosed area. Additionally, the floor exhaust removes contaminants from the enclosed area.

The present invention may provide a downward air flow for use within an automotive cleaning, painting, and/or welding booth by providing a pit or passageway disposable beneath a work area. The present invention may be disposable within pre-formed booths or in other locations without much installation. The present invention may provide a passageway that may extend a minimal length away from a surface, so that a user is unlikely to trip over it.

The present invention, in one embodiment, may be a sloped surface comprising a plurality of diffusion baffles and air filters disposed over two pre-defined rows that connect to a smooth central exhaust tunnel or duct. The sloped surface may allow a user to easily transport an object above the surface and work on the underside of any object placed on the surface. The present invention may require less assembly time and materials to install than a normal floor pit because no ground needs to be excavated. The present invention may be placed on a surface, in a booth, or in a room and may have a low height so as not to decrease the volume or height of the booth or room, or require the room or booth to be heightened. The present invention may be compact and fit entirely within a pre-existing booth so as not to take up additional space. Many additional benefits will be discussed with reference to the figures.

Figure 1:
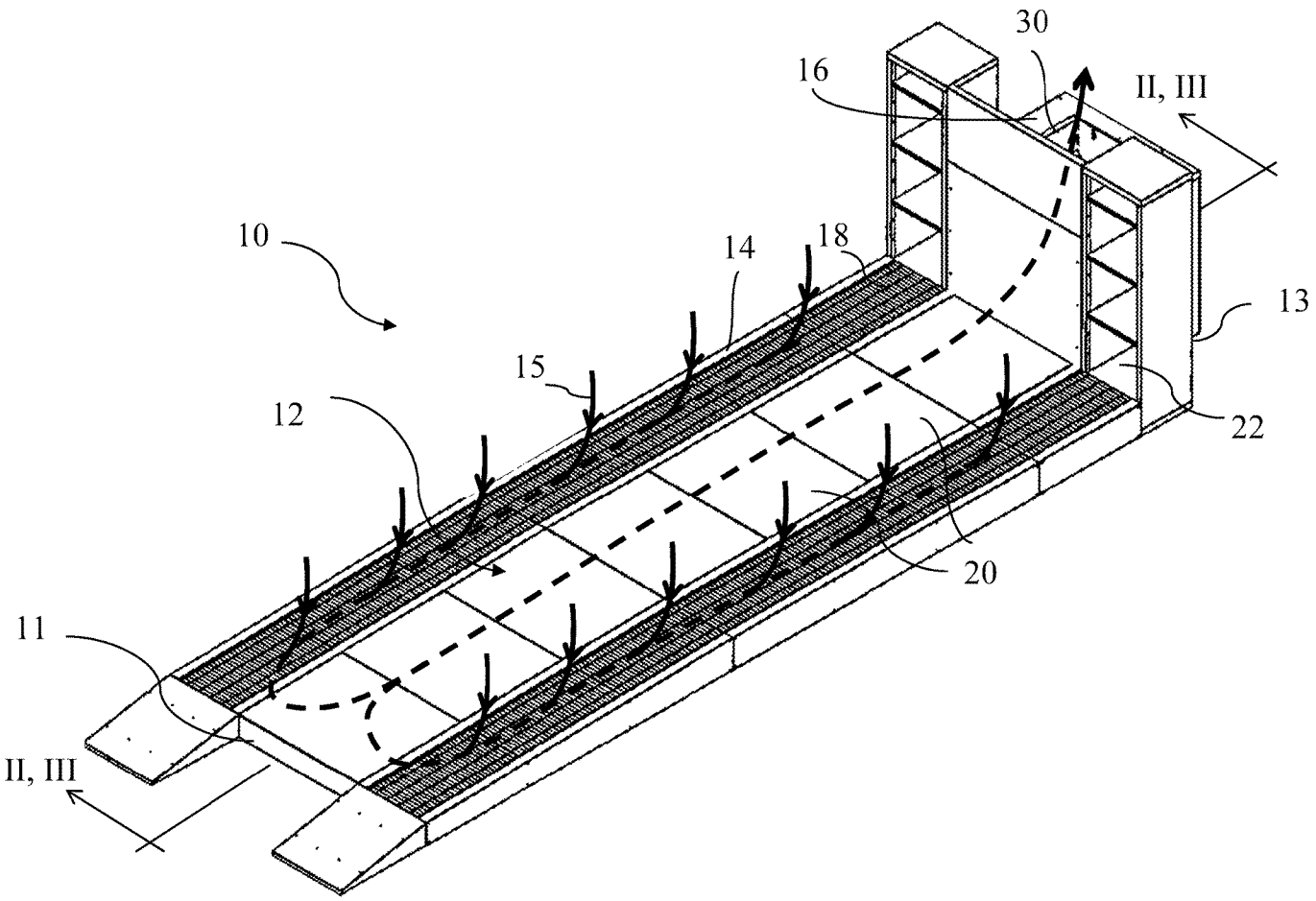
FIG. 1 illustrates a perspective view of an above ground exhaust pit in a preferred embodiment of the present invention.

Now referring to the figures, wherein like numerals refer to like parts, FIG. 1 illustrates an above ground exhaust pit 10 in a preferred embodiment of the present invention. The above ground exhaust pit 10 may comprise a work area 12 with at least one passageway 14 and an exhaust system 16.

The at least one passageway 14 may be covered by at least one grating 18. The at least one grating 18 may allow air to pass freely between the work area 12 at least one passageway 14, as shown by a downward air flow 15. Additionally, the at least one grating 18 may have sufficient strength to allow a user to walk thereon and to support a vehicle, machinery, or other object to be worked on. In one embodiment, the at least one grating 18 may be able to support around 5,100 pounds.

Additionally, the at least one passageway 14 may extend a length horizontally so that the at least one passageway 14 extends the entire length of a vehicle, machinery, or other object to be worked on in the work area 12. This may allow air flow to envelop the front and back of the vehicle, machinery, or other object more efficiently. Further, this may prevent overspray of paint or chemicals from ending up on a plurality of panels 20.

The plurality of panels 20 may seal off the area beneath the vehicle, machinery, or other object being worked on, in order to direct air flow towards an exhaust vent 30, as indicated by downward air flow 15. The plurality of panels 20 may have sufficient strength to allow a user to walk thereon and to support a vehicle, machinery, or other object to be worked on. In one embodiment, the plurality of panels 20 may be able to support around 5,100 pounds.

The downward air flow 15 may show how the at least one passageway 14 interacts with the exhaust system 16. The downward air flow 15 may be drawn into the at least one passageway 14 through the at least one grating 18. The downward air flow 15 may travel towards a first end 11 of the above ground exhaust pit 10. The downward air flow 15 may then enter into the area beneath the plurality of panels 20. The downward air flow 15 may then travel towards a second end 13 of the above ground exhaust pit 10 where the exhaust system 16 is located. The downward air flow 15 may exit the above ground exhaust pit 10 through the exhaust vent 30. This downward air flow 15 may be continuous, periodic, or temporary as determined by a user. The user may be able to set a time and/or a rate of air flow, or a user may merely turn the exhaust system 16 on or off. Alternatively, the user may be able to reverse the air flow.

The exhaust vent 30 may be connected to a ventilation system that extends outside of a work both when the above ground exhaust pit 10 is installed in new and/or pre-existing booths. Alternatively, the exhaust vent 30 need not be connected to anything if the above ground exhaust pit is being used in an open area. In another embodiment, the exhaust vent 30 may be directional such that an air flow may be directed away from the work area 12.

In one embodiment, the plurality of panels 20 may be replaced with additional passageways 14 for more air flow surface area. As shown in FIG. 1, the plurality of panels 20 may be disposed in the center of the above ground exhaust pit 10. In another embodiment, the plurality of panels 20 may be placed on the sides of the above ground exhaust pit 10 and the at least one passageway 14 may be disposed in the center of the above ground exhaust pit 10.

The above ground exhaust pit 10 may further comprise storage space 22 disposed on one end of the above ground exhaust pit 10. The above ground exhaust pit 10 may be manufactured and/or sold as a single unit. Alternatively, each component may be separately manufactured and/or sold and may be subsequently combined at the discretion of the user. The above ground exhaust pit 10 may be moved between locations, may be installed in new work booths, or may be inserted into pre-existing work booths.

Figure 2:
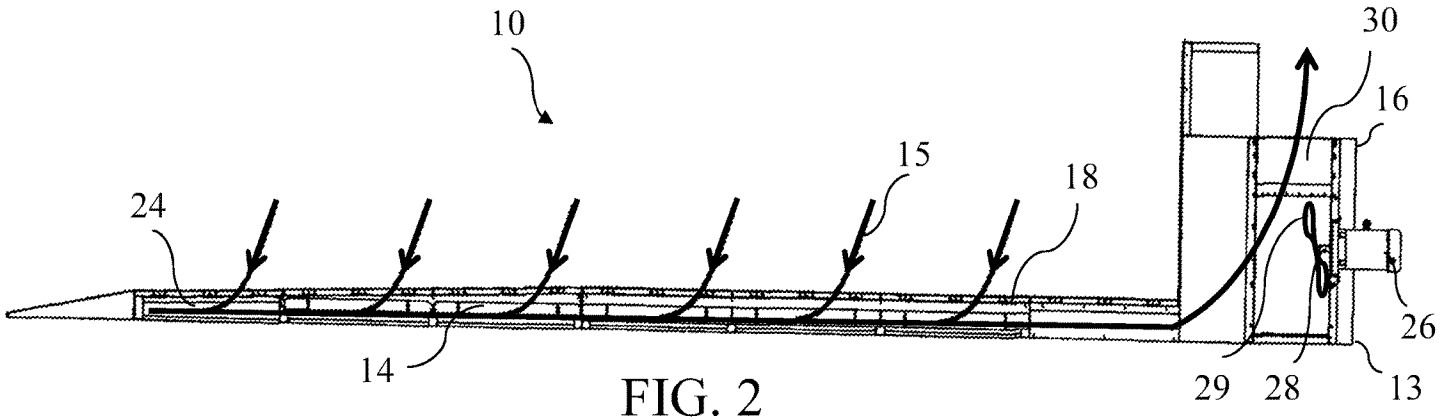
FIG. 2 illustrates a cross-section view of the above ground exhaust pit with a first air flow in a preferred embodiment of the present invention.

As seen in FIG. 2, a cross-section view of the above ground exhaust pit 10 is shown. The exhaust system 16 may be disposed on the second end 13 of the above ground exhaust pit 10. The exhaust system 16 may be interconnected with the at least one passageway 14 through one or more entryways 24. The exhaust system 16 may comprise a motor 26, a fan rotor 28, a fan 29, and the exhaust vent 30. The motor 26 may be used to rotate the fan rotor 28, and the fan 29, to create a suction force. The suction force may pull air from within the at least one passageway 14 towards and through the one or more entryways 24, and towards the exhaust system 16. The air from within the at least one passageway 14 may be sucked towards the exhaust system 16, and additional air may be pulled into the at least one passageway 14 through the at least one grating 18. The air sucked toward the exhaust system 16 may be forced outward through the exhaust vent 30 away from the above ground exhaust pit 10. Therefore, the downward air flow 15 may be created.

Figure 3:
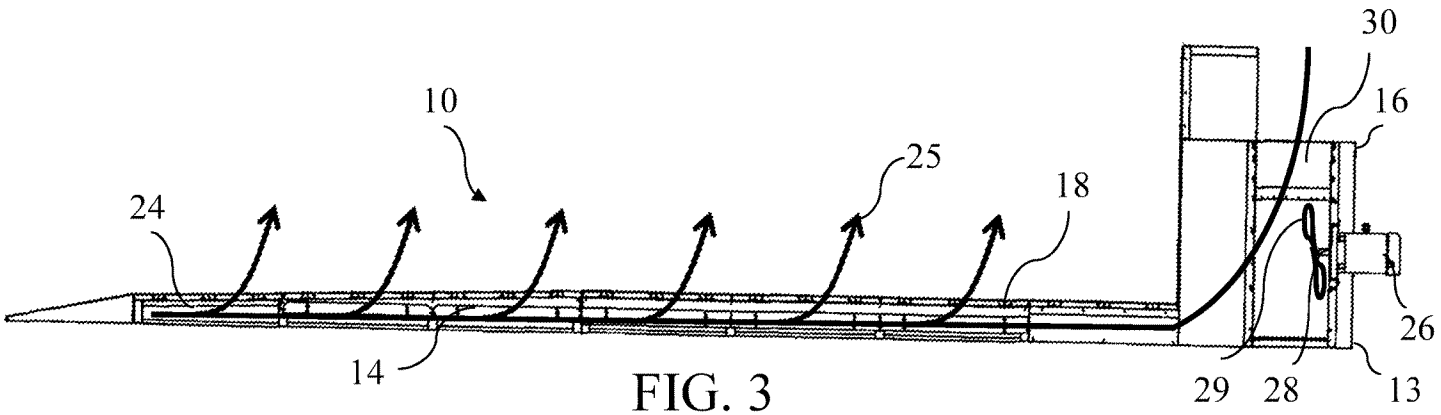
FIG. 3 illustrates a cross-section view of the above ground exhaust pit with a second air flow in an alternate embodiment of the present invention.

Of course, the exhaust system 16, specifically the fan rotor 28 and fan 29, may be reversed and may create a blowing force instead of a suction force, as seen in FIG. 3. In this embodiment, the fan rotor 28 and fan 29 may blow air from the exhaust vent 30 through the one or more entryways 24 and into the at least one passageway 14. Air within the at least one passage way 14 may be pushed outwardly through the at least one grating 18. In this way, an upward air flow 25 may be created. Additionally, the above ground exhaust pit 10 may be coupled with an overhead airflow system (not shown) to further accelerate and/or control the downward air flow 15 or the upward air flow 25.

Figure 4:
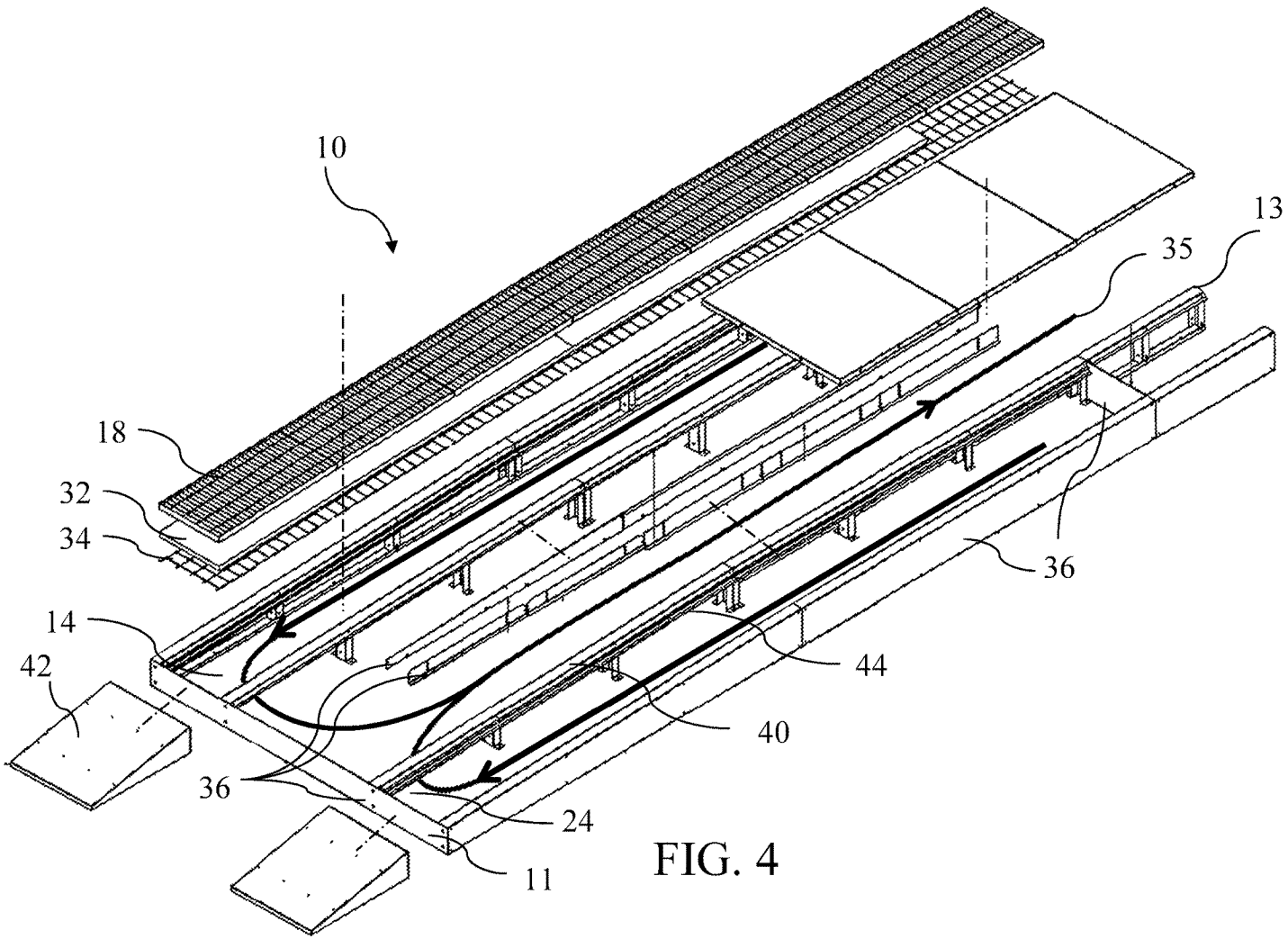
FIG. 4 illustrates an exploded view of the above ground exhaust pit components with a first air flow in an embodiment of the present invention.

As seen in FIG. 4, an exploded view of the above ground pit 10 is shown. From this view the details of the present invention may be appreciated. Specifically, between the at least one grating 18 and the at least one passageway 14 may be multiple filtration layers. Even more specifically, at least one filter 32 may be disposed beneath the at least one grating 18. The at least one filter 32 may allow air to flow therethrough, but may collect contaminants therein, thereby cleaning the air and collecting contaminants for disposal. The at least one filter 32 may be made of a fibrous material that may be able to remove solid particles or contaminants from the air. This may include paper, foam, cotton, fiberglass, oil baths, any combination thereof, or alternative fibrous material known to one skilled in the art. The at least one filter 32 may be made according to chemical absorption, wherein molecular contaminants may be removed from the air. Additionally, the at least one filter 32 may be an air ionizer, which may remove contaminants based on the contaminants' electric charge. Of course, filtration based on electric charge should be avoided in cases where volatile or combustible chemicals, fumes, and/or particles are present. Alternative methods of filtration, such as the use of ultraviolet light, treating carbon with oxygen, or other method known to one skilled in the art may be used without departing from the scope of the present invention.

Additionally, a support 34 may be disposed beneath the at least one filter 32. The support 34 may be a grid made of wire, metal, plastic, paper, cardboard, polymer, any combination thereof, or other material known to one skilled in the art that has sufficient strength to support the at least one filter 32 and at least one grating 18. The support 34 may be used to hold the at least one filter 32 in place while an air flow travels therethrough. A diffuser (not shown) may be disposed beneath the support 34 and may control the flow of air into the at least one passageway 14. Of course, the diffuser may be disposed above the support 34, the at least one filter 32, or the at least on grating 18 without diminishing its function. The diffuser may be a diffusion baffle or may merely be a pane with a plurality of holes therein. The plurality of holes may differ in size, shape, and number according to a determined air flow.

In one embodiment, the diffuser may slow or otherwise control the air flow entering the at least one passageway. In another embodiment the diffuser may prevent air disruption within the at least one passageway 14. Additionally, different diffusers may be placed throughout the length on the at least one passageway 14 to control the air flow therethrough. For example, a diffuser towards the first end 11 of the above ground exhaust pit 10 may have a large number of holes while a diffuser towards the second end 13 of the above ground exhaust pit 10 may have a small number of holes. In another example, a diffuser towards the first end 11 of the above ground exhaust pit 10 may have large holes while a diffuser towards the second end 13 of the above ground exhaust pit 10 may have small holes. Of course, any combination of holes of varying number and sizes may be used to control the determined air flow through the above ground exhaust pit 10. Alternatively, the diffuser may be replaced with a nozzle that may increase and/or direct the air flow exiting the at least one passageway 14 when the upward air flow 25 is present.

The at least one passageway 14 may be formed with a plurality of walls 36. The plurality of walls 36 may generally surround the at least one passageway 14 on four sides except for the one or more entryways 24. The plurality of walls 36 may have a connection seal disposed between each of the plurality of walls 36 to prevent air from escaping. Additionally, a bottom seal may be disposed on a bottom 38 of the plurality of walls 36 such that the plurality of walls 36 may be placed onto any surface to seal off the at least one passageway 14 from the rest of the surface. Alternatively, a floor wall may be disposed beneath the plurality of walls 36 in order to seal the bottom of the at least one passageway 14. In a preferred embodiment, the at least one passageway may be sealed on five sides, leaving the top and one or more entryways open for air to flow therethrough. The connection and bottom seals may allow air to flow through the at least one passageway 14 without loss of volume, pressure, and the like.

The plurality of walls 36 may be attached together by screws, nails, nuts and bolts, rivets, glue, sealant, or other attaching method known to one skilled in the art. Preferably, as with between the plurality of walls 36, the attaching method would maintain the seal of the at least one passageway 14. Of course, the present invention may be practiced without a complete seal on five sides and/or with air flow leakage or negligible air flow leakage.

The plurality of walls 36 may have a top 40 that may support the diffuser, the support 34, the at least one filter 32, the at least one grating 18, and/or the plurality of panels 20 thereon. The top 40 may have a plurality of recesses 44 that may allow the top 40, the plurality of panels 20, and the at least one grating 18 to be on the same plane, as shown in FIG. 1. The plurality of walls 36 may be rectangular, trapezoidal, arcuate, polygonal, another shape known to one skilled in the art, and/or any combination thereof. Preferably, the plurality of walls 36 may decrease in height and/or terminate in at least one ramp 42. The at least one ramp 42 and decreasing height of the plurality of walls 36 may facilitate entry of a vehicle, machine, or other object into the work area 12 of the above ground exhaust pit 10.

Figure 5:
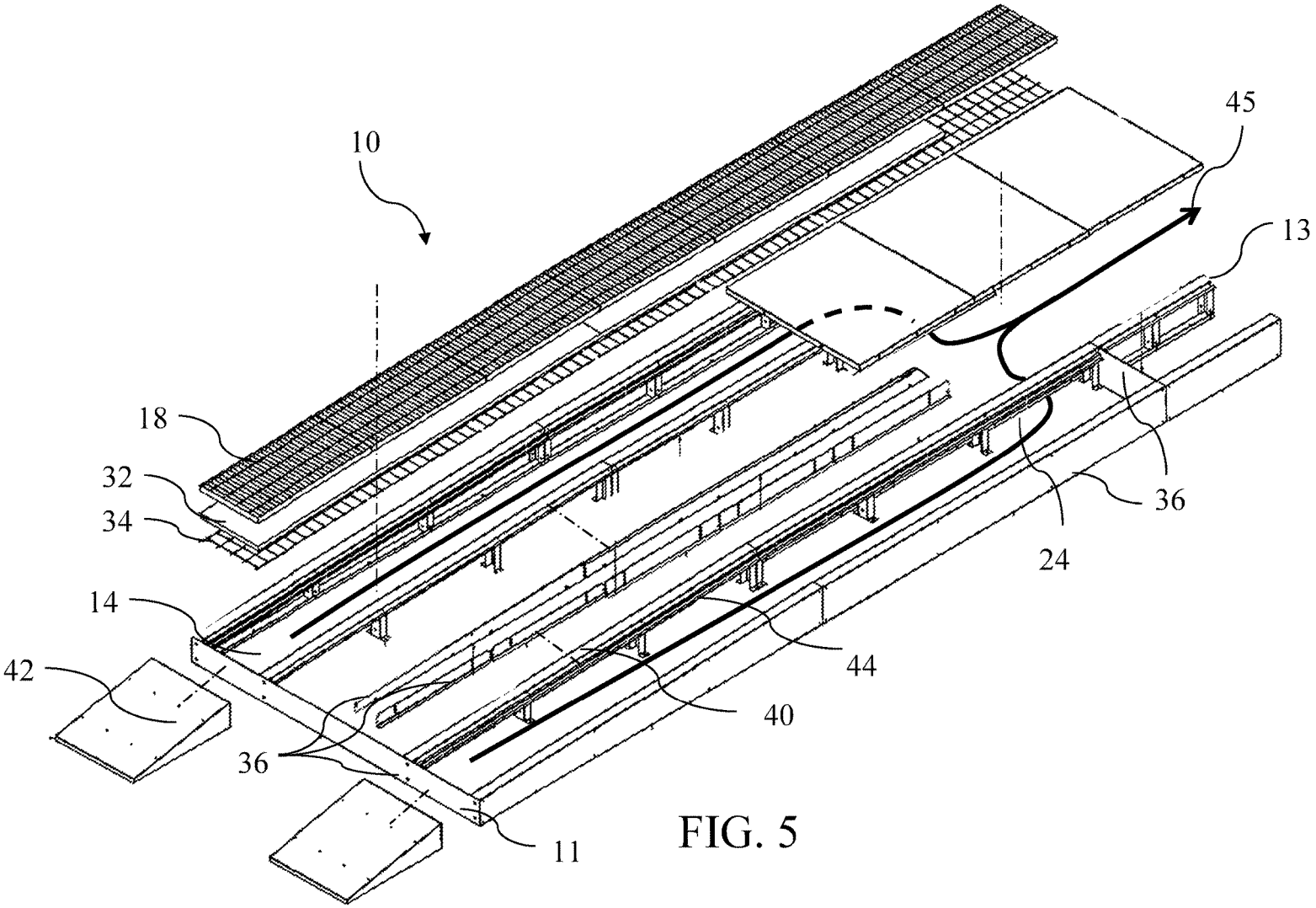
FIG. 5 illustrates an exploded view of the above ground exhaust pit components with a second air flow in an embodiment of the present invention.

As shown in FIG. 4, the one or more entryways 24 may be disposed near the first end 11 of the above ground exhaust pit 10. When the one or more entryways 24 are disposed near the first end 11 of the above ground exhaust pit 10, a first air flow 35 may be formed beneath the plurality of panels 20. As shown in FIG. 5, in an alternate embodiment of the present invention, the one or more entryways 24 may be disposed near the second end 13 of the above ground exhaust pit 10. A second air flow 45 may be formed beneath the plurality of panels 20 when the one or more entryways 24 are disposed near the second end 13 of the above ground exhaust pit 10.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An automotive paint booth comprising an enclosed area comprising a floor surface and a ceiling, and a plurality of sidewalls:

an above ground exhaust pit within the automotive paint booth comprising:

a platform disposed a length above the floor surface, the platform having a first end and a second end opposite the first end, the platform further comprising an exhaust system disposed within a wall on the second end and a ramp on the first end configured to allow automobiles to drive onto the platform;

a first hollow passageway disposed between the platform and the floor surface;

a first grating disposed on the platform and above the first hollow passageway; and a first filter disposed between the first hollow passageway and first grating;

a second hollow passageway disposed between the platform and the surface;

a second grating disposed on the platform and above the second hollow passageway;

a second filter disposed between the second hollow passageway and the second grating;

a solid panel disposed between the first and second grating, wherein the solid panel is configured to prevent airflow therethrough;

a third hollow passageway between the solid panel and the surface;

a first wall between the first hollow passageway and the third hollow passageway disposed the length of the platform and configured to prevent airflow therethrough except for a first opening between the first hollow passageway and the third hollow passageway at the first end of the platform, wherein the first opening is configured to allow airflow from the first hollow passageway to the third hollow passageway;

a second wall between the second hollow passageway and the third hollow passageway disposed the length of the platform and configured to prevent airflow therethrough except for a second opening between the second hollow passageway and the third hollow passageway at the first end of the platform, wherein the second opening is configured to allow airflow from the second hollow passageway to the third hollow passageway.

2. The above ground exhaust pit of claim 1 wherein the first grating can support more than 5000 pounds.

3. The above ground exhaust pit of claim 1 further comprising:

an exhaust vent disposed on the second end of the platform in communication with the third hollow passageway disposed between the platform and the surface and configured to direct airflow from the first hollow passageway and away from the platform.

4. The above ground exhaust pit of claim 1 further comprising:

an automobile disposed on the platform.

5. A method of using an above ground exhaust pit comprising the steps of:

providing an above ground exhaust pit comprising a platform disposed a length above a surface, the platform having a first end and a second end opposite the first end, the platform further comprising an exhaust system disposed within a wall on the second end and a ramp on the first end configured to allow automobiles to drive onto the platform, a first hollow passageway disposed between the platform and the surface, a first grating disposed on the platform and above the first hollow passageway, and a first filter disposed between the first hollow passageway and first grating, a second hollow passageway disposed between the platform and the surface, a second grating disposed on the platform and above the second hollow passageway, a second filter disposed between the second hollow passageway and the second grating, a solid panel disposed between the first and second grating, wherein the solid panel is configured to prevent airflow therethrough, a third hollow passageway between the solid panel and the surface, a first wall between the first hollow passageway and the third hollow passageway disposed the length of the platform and configured to prevent airflow therethrough except for a first opening between the first hollow passageway and the third hollow passageway at the first end of the platform, wherein the first opening is configured to allow airflow from the first hollow passageway to the third hollow passageway, a second wall between the second hollow passageway and the third hollow passageway disposed the length of the platform and configured to prevent airflow therethrough except for a second opening between the second hollow passageway and the third hollow passageway at the first end of the platform, wherein the second opening is configured to allow airflow from the second hollow passageway to the third hollow passageway; and directing an airflow through the first grating and the first filter into the first hollow passageway wherein the airflow is then directed through the first opening into the third hollow passageway and further then directed into the exhaust system; and venting the airflow away from the platform.

6. The method of claim 5 wherein the above ground exhaust pit further comprises an exhaust vent on the second end of the platform wherein the exhaust vent draws the airflow from the third hollow passageway and away from the platform.

7. The method of claim 5 further comprising the step of: disposing and automobile on the platform.

* * * * *